252-99 AU 165 EX
7/27/76 XR 3,971,726

United States Patent [19]
Smith, Jr. et al.
[11] 3,971,726
[45] July 27, 1976

[54] PROCESS FOR LOWERING THE BULK DENSITY OF ALKALI MAKING BUILT SYNTHETIC DETERGENT COMPOSITIONS

[75] Inventors: Frank R. Smith, Jr., North Plainfield; Edward J. Kenney, Bernardsville; Walter A. DiSalvo, North Arlington, all of N.J.

[73] Assignee: Colgate-Palmolive Company, New York, N.Y.

[22] Filed: Apr. 22, 1974

[21] Appl. No.: 462,682

Related U.S. Application Data

[63] Continuation of Ser. No. 298,936, Oct. 19, 1972, abandoned, which is a continuation-in-part of Ser. No. 124,111, March 15, 1971, Pat. No. 3,886,098, which is a continuation-in-part of Ser. No. 203,365, Nov. 30, 1971, abandoned, which is a continuation-in-part of Ser. No. 224,694, Feb. 9, 1972, Pat. No. 3,849,327.

[52] U.S. Cl. ..... 252/132; 252/89 R; 252/99; 252/108; 252/109; 252/110; 252/135; 252/539; 252/540; 252/368

[51] Int. Cl.[2] ..... C11D 9/12; C11D 15/04

[58] Field of Search ..... 252/89, 99, 109, 110, 252/132, 135, 539, 540, 108, 368

[56] References Cited

UNITED STATES PATENTS

| | | | |
|---|---|---|---|
| 2,925,390 | 2/1960 | Flitcraft | 252/116 |
| 2,947,701 | 8/1960 | Ruff | 252/109 |
| 3,216,946 | 11/1965 | Curtin | 252/156 |
| 3,242,091 | 3/1966 | Monick | 252/109 |
| 3,519,570 | 7/1970 | McCarty | 252/135 |
| 3.590,001 | 6/1971 | Taylor | 252/539 |

OTHER PUBLICATIONS

"Synthetic Detergents" by Davidsohn et al., 1967, pp. 36, 37, & 53.

"Eutrophication of Lake Water Microcisms: Phosphate vs. Nonphosphate Detergents" by Mitchell, Science, vol. 174, pp. 827–829, 11/19/1971.

*Primary Examiner*—Mayer Weinblatt
*Attorney, Agent, or Firm*—Steven J. Baron; Norman Blumenkopf; Herbert S. Sylvester

[57] ABSTRACT

Spray dried beads, having a low bulk density and high in alkali metal carbonate content and useful for post-treatment with additional amounts of nonionic detergent to produce a heavy duty detergent compositon of a bulk density in the range of 0.2 to 0.35 gram per milliliter, are made by admixing a small percentage of alkali metal soap of higher fatty acid with a 40–75% solids content aqueous crutcher mix comprising the alkali metal carbonate and up to about 2% by weight nonionic detergent heating the crutcher mix to 170°–190° F. and spray drying the mixture.

11 Claims, No Drawings

PROCESS FOR LOWERING THE BULK DENSITY OF ALKALI MAKING BUILT SYNTHETIC DETERGENT COMPOSITIONS

This application is a continuation of application Ser. No. 298,936 filed Oct. 19, 1972, now abandoned, which is a continuation-in-part of our U.S. patent applications Ser. No. 124,111 filed on Mar. 15, 1971, now U.S. Pat. No. 3,886,098; Ser. No. 203,365 filed on Nov. 30, 1971, now abandoned; and Ser. No. 224,694 filed Feb. 9, 1972, now U.S. Pat. No. 3,849,327.

This invention relates to a method for diminishing the bulk density of spray dried beads high in alkali metal carbonate content. More particularly, it relates to the addition of a small quantity of a higher fatty acid soap to a high carbonate content aqueous crutcher mix and heating the mix, from which the beads are then sprayed.

In the production of particulate synthetic detergents high in alkali metal carbonate content it has been noted that the spray dried beads have higher bulk densities than are normally desirable for detergent products. This is especially noticeable when a product of the spray drying operation is essentially sodium carbonate or essentially a mixture of inorganic salts, of which sodium carbonate is an important, often a major component. It is also noted in high carbonate detergent compositions which also contain minor proportions, e.g., 2 to 20%, of anionic synthetic organic detergent in the spray dried beads. The problem is accentuated when the spray dried materials are post-sprayed with normally liquid or liquefied solid nonionic, surface active or detergent compound(s) because the post spraying can tend to increase the bulk density further.

It has now been discovered that the problem of making low bulk density spray dried detergent beads containing substantial proportions of alkali metal carbonate can be solved by a simple, inexpensive and additionally useful method, which is readily practicable in conjunction with normal spray drying operations. It has been found that the addition of a very small proportion of alkali metal soap to an aqueous crutcher mix comprising the alkali metal carbonate results in a low density spray dried bead and such bead is also maintained at a satisfactory low density after post spraying with nonionic detergent or surface active agent. The production of the desired low density of heavy duty detergent beads is aided significantly by having the crutcher mix at an elevated temperature, e.g., 170°–190°F., before spraying.

In accordance with the present invention a method of spray drying high alkali metal carbonate content beads, useful to be post-treated with nonionic detergent to produce a heavy duty detergent composition, so that the bulk density of such spray dried beads is in the range of 0.2 to 0.35 gram per milliliter, comprises admixing with a 40–75% solids content aqueous crutcher mix containing said alkali metal carbonate, from 0.75 to 4% of an alkali metal soap of a higher fatty acid and spray drying the resulting mixture, preferably with the crutcher mix being sprayed being at a temperature of 170° to 190°F.

The sodium carbonate compositions that are sprayed in accordance with the present invention may include sodium carbonate and a small proportion of alkali metal soap, usually with a small proportion of moisture also present. Although the importance of the sodium carbonate processes is much greater, it is noted that sodium sesquicarbonate and sodium bicarbonate are also improvable by the present method so that the bulk densities thereof are also diminished after spray drying. Normally the proportion of sodium carbonate present in spray dried detergent beads will be from 20 to 95%, and for the present processes this is preferably from 50 to 90%, at which concentrations the proportion of alkali metal soap will best be from 0.75 to 4% and there will usually be present from 1 to 12% of moisture. The balance of such compositions may be other inorganic builder salts, filler salts, synthetic organic detergents or various adjuvents for such detergent compositions. When reference is made to alkali metal carbonate, sesquicarbonate or bicarbonate herein, especially when weights or proportions of materials are being described, it is intended to refer to the anhydrous forms, although these may be accompanied by water in the crutcher mix, spray dried beads or detergent compositions. Also, reference to carbonate includes the sesquicarbonate and applies to bicarbonate, too.

The soap employed is an alkali metal salt of a higher fatty acid or a mixture of fatty acids. Such fatty acids are normally in the 12 to 18 carbon range and, although potassium soaps may be employed, usually to a minor extent with respect to the soap content of the crutcher mix, it is preferable to utilize sodium soaps. Also, while it may be desirable to have the soaps of the lower fatty acids in the mentioned group available for their detergent effects, to produce the best bulk density diminutions it appears preferable for a substantial part of the soap content be toward the higher end of the $C_{12-18}$ fatty acid range. Thus, from 60 to 100% of the fatty acids of the soap will preferably be of 16 to 18 carbon atoms and most preferably, this content will be from 75 to 100%. Also, it will be preferred that the soap be of saturated fatty acids, rather than those which are unsaturated, although often oleic acid may be employed almost interchangeably with the more saturated fatty acids. The most saturated and highest fatty acid soap within the description is one of hydrogenated tallow fatty acids which is essentially of 16 to 18 carbon atoms or it may be of stearic acid. Yet, other soaps which are of acids in the rest of the $C_{12-18}$ range are also useful. Such soaps may be made from synthetic fatty acids, natural fats and oils and fatty acids derived from such fats and oils. For example, they may be obtainable from tallow, lard, coconut oil, cottonseed oil, safflower oil, palm kernel oil, and various other of the usual soap making natural animal and vegetable fats and oils and hydrogenated derivatives thereof. When mixed fats and oils are employed to make the soaps, it is preferred that they comprise from 75 to 90% of tallow or hydrogenated tallow and 10 to 25 % of coconut oil.

In addition to the alkali metal carbonate of the crutcher mix from which the spray dried product is made, other inorganic salts may also be present, principally as builders or fillers for a detergent component of the final product, which detergent may be added in the crutcher mix or by post spraying. An important builder salt constituent of this type is sodium silicate, although other alkali metal silicates may be used. Of the sodium silicates which are employed those having an $Na_2O$:-$SiO_2$ ratio of from 1:1.6 to 1:3.4, preferably from 1:2 to 1:3 and most preferably about 1:2.4, are most favored. If phosphates are acceptable, pentasodium tripolyphosphate and tetrasodium pyrophosphate are desirable supplementary builders. Trisodium nitrilotriacetate may be employed as a substitute for such materials if it is environmentally acceptable but it is preferred that the content thereof should be minor because it may have a tendency to counter sorption of a nonionic detergent overspray. Among the other builders that are useful are various other phosphates, borates, e.g., borax, sodium gluconate, sodium citrate and EDTA. The best filler salt is sodium sulfate and sodium chloride may also sometimes be employed for this purpose, as may be other compatible water soluble salts.

Although it is not necessary to have a synthetic organic anionic detergent incorporated in the crutcher mix or in the product after the beads are sprayed, such detergents are frequently desirable constituents of the product because they contribute particular detersive properties to the final composition. Yet, if desired, the active detergent constituent may be solely a nonionic detergent, the greater proportion of which is post-added onto the spray dried beads in a subsequent spraying operation.

The anionic detergent is preferably a higher alkyl benzene sulfonate, especially a water soluble salt of a linear higher alkyl benzene sulfonate, e.g., the alkali metal salt or sodium salt of a linear higher alkyl benzene sulfonate. However, other anionic detergents may also be present. Such compounds are well known in the detergent art and are described at length at pages 25 to 138 of the text, *Surface Active Agents and Detergents*, Vol. II, by Schwartz, Perry and Berch, published in 1958 by Interscience Publishers, Inc. Among the most useful anionic compounds so described are the higher alkyl sulfates, the higher fatty acids monoglyceride sulfates, the higher alkyl sulfonates, the sulfated phenoxy polyethoxy ethanols, the branched higher alkyl benzene sulfonates, the higher linear olefin sulfonates, e.g., hydroxyalkane sulfonates and alkenyl sulfonates, including mixtures, higher alkyl ethoxamer sulfates and methoxy-higher alkyl sulfates, such as those of the formula $RO(C_2H_4O)_nSO_3M$, wherein R is a fatty alkyl of 12 to 18 carbon atoms, $n$ is from 2 to 6 and M is a solubilizing salt-forming cation, such as alkali metal, and

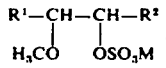

wherein $R^1$ and $R^2$ are selected from a group consisting of hydrogen and alkyls, with the total number of carbon atoms in $R^1$ and $R^2$ being in the range of 12 to 18.

Other descriptions of the anionic synthetic organic detergents which are useful may be found in our previously mentioned parent applications and in three patent applications of Paul S. Grand, mailed to the U.S. Patent Office on Nov. 10, 1971, and entitled Detergent Compositions, Sulfonate Detergent Compositions and Sulfate Detergent Compositions, respectively, which are herein incorporated by reference. These applications also describe various other components of the present formulations, including builder salts, filler salts and adjuvants, and give formulas for suitable detergent compositions including such materials.

Of the various anionic detergents mentioned the preferred salts are sodium salts and the higher alkyls are of 10 or 12 to 18 carbon atoms, preferably of 12 to 18 carbon atoms, except where otherwise mentioned. Specific exemplifications of such compounds include: sodium linear tridecyl benzene sulfonate; sodium linear pentadecyl benzene sulfonate; sodium p-n-dodecyl benzene sulfonate; sodium lauryl sulfate; potassium coconut oil fatty acids monoglyceride sulfate; sodium dodecyl sulfonate; sodium nonyl phenoxy polyethoxy ethanol (of 30 ethoxy groups per mole); sodium propylene tetramer benzene sulfonate; sodium hydroxy-n-pentadecyl sulfonate; sodium dodecenyl sulfonate; lauryl polyethoxy ethanol sulfate (of 15 ethoxy groups per mole); and potassium methoxy-n-tetradecyl sulfate.

Various other constituents, generally referred to as adjuvants, may be present in the crutcher mix or may be post-added to the spray dried product. These include sanitizers, e.g., trichlorocarbanilide, coloring agents, e.g., dyes and pigments, foam improvers, foam depressants, fungicides, anti-oxidants, stabilizers, perfumes, chelating agents, optical bleaches or fluorescent brighteners, soil suspending agents and soil anti-redeposition agents. With respect to the foregoing adjuvants it will normally be desirable to limit the anti-redeposition agent content in the crutcher to about 0.5%, since it has been noted that such materials counteract subsequent sorption of post-sprayed nonionics. The anti-redeposition agents referred to include sodium carboxymethyl cellulse, polyvinyl pyrrolidone, polyvinyl alcohol and similar products known in the art. Similarly, the content of sodium silicate in the crutcher mix will normally also be limited for the same general reason. However, both anti-redeposition agent and sodium silicate may be post-added to the product, frequently in conjunction with the post-spraying of the nonionic surface active agent or detergent and perfume onto the spray dried beads. Also, if desired, powdered flow-improving agent such as magnesium silicate, calcined aluminum silicate, talc or other such agent may be admixed with the spray dried beads. Of course, judgment will be employed so that normally there will not be added to the crutcher mix materials which are objectionably decomposed or vaporized off in the spray drying process, e.g., perfumes, excess nonionic surface active materials, organic solvents.

An important use for the spray dried high carbonate content beads of this invention is in the manufacture of detergent compositions in which nonionic surface active agent or detergent is admixed with or sprayed onto the surfaces of the spray dried particles. Post-spraying of such materials, rather than spray drying them with the crutcher mix, is practiced because otherwise such detergents may tend to collect on the surfaces of the atomized particles being spray dried and may make them sticky, causing them to lump together at the bottom of the tower, especially when they are warm, as they are when first deposited there. Also, the nonionic detergents are often liquid, semi-soft or in gel-like form at some of the temperatures obtaining in the spray tower and frequently will be vaporized, flashed or fumed out of the tower, thereby being lost and giving rise to objectionable air pollution. For these reasons crutcher mixes to be spray dried contain relatively small proportions of nonionic detergents and surface active agents, if any at all are present. Most of such compound(s) being added to detergent compositions or detergent builder salts is sprayed onto the surfaces of tumbling beads of inorganic builder salt or detergent base in a drum or tubular vessel, possibly together with sodium silicate solution and perfume. Powdered ingredients, such as anti-redeposition agents and flow improving agent may also be added at this time.

Although, because of the fuming of the nonionic in the spray tower and the sticking together of the spray dried beads when nonionics are present in the formulation, the presence of nonionic detergents and surface active agents in the crutcher mix will normally be avoided, in accordance with the present invention it has been discovered that in conjunction with a small percentage of soap in the crutcher mix, the presence of some nonionic allows producing a detergent bead which is of a lower bulk density than would be obtained in the absence of the soap and nonionic. As does the presence of soap in the crutcher mix, a small proportion of nonionic detergent and/or surface active agent improves the wetting and detergent properties of the spray dried detergent beads, while not promoting excessive foaming (and often limiting foaming of such compositions).

Of the nonionic detergents, those are preferred which are hydroxy-containing, essentially linear polymers of lower alkylene oxide, such as ethylene and propylene oxides, preferably the former, which are normally liquid or semi-solid at room temperature. These include condensation products of higher fatty alcohols with poly-lower alkylene glycols, such as Neodol 45-11, Plurafac B-26 and Alfonic 1618-65. Also useful are the block copolymers of propylene glycol, propylene oxide and ethylene oxide, such as the Pluronics, e.g., Pluronic L-44, and the middle alkyl phenyl polyoxyethylene ethanols, such as those sold as Igepals. In the group of higher linear alkoxy poly-lower alkoxy lower alkanol detergents, e.g., Neodol 45-11, the higher linear alkoxy is usually of 10 to 18 or 10 to 16 carbon atoms, most preferably of 12 to 15 carbon atoms, and the poly-lower alkoxy alkanol is one in which the lower alkoxy and alkanol are of 2 to 3 carbons each, with the total of carbon atoms in the poly-lower alkoxy lower alkanol, which is preferably polyethoxy ethanol, being 20 to 30. More preferably, the higher alkoxy is of 14 to 15 carbon atoms and the poly-lower alkoxy lower alkanol is of about 22 carbon atoms. Other nonionic detergents of this general type, also made by Shell Chemical Company, the manufacturer of Neodol 45-11, are also useful when they are of 10 to 18 or 13 to 16 carbon atoms in the higher alkanol and of 20 to 26 carbon atoms in the polyethoxy ethanol portions of the molecule. Such compounds, sold under the trade name Neodol 25-7, most preferably include alkanol portions of 12 to 15 carbon atoms and polyethoxyethanol moieties of about 14 carbon atoms. A similar compound which is more a solvent or surface active agent than a detergent, is the corresponding Neodol 25-3, which is like Neodol 25-7 but contains only 6 carbon atoms in the diethoxyethanol portion of the molecule. Portions of the mentioned nonionics may be replaced by other equivalent compounds and such replacement may be made in part by the Pluronic-type materials which are block copolymers of propylene oxide and ethylene oxide, chain-terminated with propylene glycol; alkyl ($C_7$–$C_9$) phenoxy polyethoxy (6-30 ethoxies) ethanols and mixed polyoxyethylene-polyoxypropylene glycols (Ucons) of sufficient molecular weights to possess detergent or surface active properties. The partial replacement of the higher alkanol poly-lower alkoxy lower alkanols (of the Neodol types) by the other nonionic detergents will normally be limited to from 10 to 40% of the nonionic content.

The proportions of the various materials in the spray dried detergent beads before any post-spraying will normally be such that the alkali metal soap is from 0.75 to 4% thereof, preferably 2 to 4% and most preferably about 3%, and the polyethoxylated nonionic organic detergent or surface active agent, if present, will be from 0.5 to 2%. The moisture content of the particles will generally be from 1 to 10 or 12%, preferably about 5% and the balance may be alkali metal carbonate, preferably sodium carbonate. A portion of the sodium carbonate may be replaced by other builder salts, anionic synthetic organic detergent, anionic organic builder and various of the other adjuvants previously mentioned but generally from 50 to 90% of the product will be sodium carbonate although in some cases as much as 95% or as little as 20% can be present. As was mentioned, the anti-redeposition agent will usually not be in the spray dried bead to an extent of over 0.5% and the content of sodium silicate will preferably be held to 15% and otherwise will be less than 20%, e.g., 5 to 20%, preferably 5 to 15%. The anionic synthetic organic detergent content may be from 2 or 5 to 20%. At greater concentrations it controls bead bulk density and the soap effect is diminished.

The crutcher mix from which the detergent beads are produced is an aqueous crutcher mix and for efficiency of operation it is preferred that the solids content be as high as feasible. This is usually from 40 to 75% solids, preferably 50 to 75% thereof. The balance is normally water, although some non-flammable solvents may also be employed together with the water. Using such a crutcher mix, the mentioned proportion of soap of the type described, sometimes with enough polyethoxylated nonionic organic detergent or surface active agent to make 0.5 to 2% thereof in the spray dried beads, it is noted that the bulk density of the beads made is from 0.2 to 0.35 gram per milliliter, whereas without the soap or soap and nonionic detergent in the crutcher mix the density rises to from 0.4 to 0.7 g./ml. and often to from 0.5 to 0.7 g./ml.

The crutching of the detergent composition is effected by usual methods known in the art. Various apparatuses which may be employed are shown in the drawings of the parent patent applications but because the present invention relates primarily to utilization of the mentioned small proportions of soap in the high carbonate crutcher mix, with the particular spray drying and post-spraying steps not being of special criticality, a drawing is unnecessary in the present application. The crutcher mix will be heated to a temperature of about 170°–190°F., preferably 175°–185°F. and most preferably 175°–180°F., can be aerated (often preferable) and will be sprayed through spray drying nozzles at a pressure of about 200 to 2,000 lbs. per square inch to globular droplets which will pass through a drying gas, usually composed of products of the combustion of oil or gas, passing countercurrently with respect to the falling droplets. The drying gas is normally initially at a temperature of 150° to 350°C. The droplet sizes from the spray drying nozzles will be such as to result in the desired particle sizes of the product, which will be substantially in the 6 to 200 or 6 to 140 mesh particle size range, preferably from 8 to 100 mesh, U.S. Standard Sieve Series, which is also the preferred size range of the final post-sprayed particles made. The particles may be screened to remove tailings and fines may be taken out before any post spraying of liquid ingredients onto the surfaces thereof. The moisture content of the product will normally be from 1 to 15%, generally from 1 to 10% or 12% and preferably about 5%. The dried particles resulting, which may be at a temperature of 10° to 65°C., usually from 27° to 43°C., shortly after the fall to the tower bottom, will be ready for post treatment with nonionic detergent or surface active agent and with other ingredients previously mentioned. When they are fresh and warm they are not excessively tacky and they may be post-sprayed with nonionics and other materials without agglomerating objectionably or becoming unacceptably tacky. The bulk densities of the spray dried beads, in the particle sizes range mentioned are in the 0.2 to 0.35 g./ml. range.

After production of the high carbonate content spray dried beads, preferably those of 8 to 100 mesh and of a bulk density of about 0.25 or 0.3. the beads, either warm, as mentioned, or cooled, after storage, are sprayed with a finely divided spray of the nonionic surface active agent or detergent, usually at a temperature sufficiently elevated to liquefy the nonionic, e.g., 40° to 60°C., or in a solvent or plasticizing medium which accomplishes the same effect at a lower temperature. The overspray is preferably of a polyethoxylated nonionic organic detergent, such as one of the Neodol type, and the total overspray which is utilized is such as to make the final content of such nonionic about 5 to 15% of the product, preferably about 10% thereof, for best detergency. Overspraying is normally conducted in an agitated zone, to present new surfaces of the beads to the spray. It is found that the presence of soap and nonionic detergent in the spray dried bead does not inhibit the satisfactory overspraying and in fact, appears to assist it. The beads sprayed are substantially maintained in their original shapes and the nonionic is satisfactorily sorbed. In addition to the postspraying with the nonionic detergent or surface active agent or mixture thereof, in the tumbling operation it is desirable to add anti-redeposition agent, perfume, sometimes sodium silicate, either as a solid or in solution, and a flow improving agent, such as that sold as Satintone, which is a calcined aluminum silicate.

After completion of the post spraying, the treated spray dried beads are removed from the mixer or tumbler apparatus utilized and if any oversize particles are present these may be screened out, size reduced or otherwise treated or recycled so as eventually to be in a desirable particle size range. The product made is free flowing, of a satisfactory bulk density, usually of about 0.25 to 0.4 g./ml. and is an excellent washing agent of good storge characteristics and satisfactory appearance.

The use of a small proportion of soap to diminish the bulk density of the product is an unexpected advantage of this invention. While greater proportions of soap may be employed and are found also to have such a desirable effect, the additional improvement in diminution of bulk density is so little as to make the employment of more soap than the 4% limit given essentially uneconomical. Also, the use of less than 0.75% soap does not seem to have a sufficient effect on the bulk density to warrant its inclusion. Similarly, the employment of from 0.5 to 2% of the nonionic polyethoxylated surfactant or detergent in the crutcher has its best effect in the range described.

The following examples illustrate the invention but do not limit it. Unless otherwise mentioned, all parts are by weight and all temperatures are in °C.

EXAMPLE 1

| | Pounds |
|---|---|
| Water | 2,341 |
| Soda ash | 3,580 |
| Aqueous sodium silicate solution, 43.5% solids ($Na_2O:SiO_2$ = 1:2.35) | 1,676 |
| Sodium coco-tallow kettle soap, 70% solids (coco:tallow = 20:80) | 214 |
| *$RO(CH_2CH_2O)_nCH_2CH_2OH$ | 102 |

*R is a primary alkyl of 14 to 15 carbon atoms and n is 10.

The above crutcher mix is prepared in a commercial heated detergent crutcher and prior to the addition of the soap and the nonionic the previously made mix of water, soda ash, dissolved in the water, and silicate is heated to 180°F., after which the soap and the nonionic surface active compound are added and the temperature is maintained. Suitable adjuvants may also be added in the crutcher, for example, optical bleaches, antimicrobial compounds, colorants. After sufficient mixing, which takes about 5 to 15 minutes, the heated fluid crutcher mix, with air injected into it just before spraying, at the rate of 15 to 20 cubic feet per minute, to regulate spraying properties, is spray dried. The crutcher mix is pumped to conventional tower spray nozzles by a high pressure pump at a pressure of about 660 lbs./sq. in. gauge. The inlet air temperature to the countercurent spray drying tower is about 600°F. and the outlet temperature of the drying air is about 175°F. Spray drying of the crutcher mix takes about 11 minutes and seven crutcher batches are made. The bead produced has a moisture content of 4.5%, a density of 0.3 g./ml. a flow rating of 65% (excellent flow) and is non-tacky.

Onto the spray dried beads, being tumbled in a tumbling drum, additional nonionic detergent and di-cocoyl amine, mixed in with the detergent so that the final product will contain 11.8% of the nonionic and 1% of the di-cocoyl amine, are sprayed. The spraying technique employed is that of our previously mentioned parent patent applications, especially Ser. No. 224,694, incorporated by reference herein. The final product made has a density like that of the starting beads, a flow rate of 63% (very good) and is non-tacky.

In a further series of runs some of the original spray dried product is treated in the tumbling drum with sodium carboxymethyl cellulose and hydrous sodium silicate, which are blended with the spray dried beads as powders, the mixture of nonionic (Neodol 45-11) and di-cocoyl amine is sprayed onto the tumbling beads, a flow-improving agent, Satintone No. 1 (calcined aluminum silicate), is added near the end of the tumbling process, and perfume is sprayed on at a suitable point in the drum, so as to manufacture a final product containing 11.8% of the nonionic detergent, 1% di-cocoyl amine, 1.7% of sodium carboxymethyl cellulose, 12% of hydrous sodium silicate (15% of the cruder hydrous sodium silicate), 1% flow improving agent and 0.2% of perfume. The product has a density about the same as that of the starting beads (0.3 g./ml.) a flow of 58% and is non-tacky. Particles sizes are entirely within the 8 to 100 mesh range.

When similar products are made, excluding the soap content, base bead density is almost double that when the soap is present. Omission of the nonionic from the crutcher mix does not have such a significant effect and no change is noted when the di-cocoyl amine is omitted from the overspray. Variations of soap content from 0.75 to 4% all result in effective diminutions of bulk densities and such diminutions, ranging to from 0.35 to 0.2 g./ml., are obtained even when the crutcher mix is not aerated before spraying, although aeration is preferred. Below 0.75% little density change is seen and above 4% no additional significant benefit is observed. At 1%, 2% and 3% additions of soap in the crutcher mix and approximately the same contents in the spray dried beads and final products, density reductions are effected, compared to controls containing no soap.

When temperatures of the crutcher mix before spraying are varied density changes are also observed. Outside the 170° to 190°F. range satisfactory diminution of density and control thereof are not obtained and best products result when the temperature is from 175° to 180°F.

When, instead of a high carbonate formula, there is sprayed a standard commercial heavy duty detergent formula, lower density products are obtainable without the presence of the soap. Apparently, sodium tripolyphosphate and other builder salts and adjuvants aid in reducing product density in such detergents.

The detergent produced by the present invention is ecologically acceptable, since it contains no phosphates. It also may be manufactured without the need for the use of sodium nitrilotriacetate and without anionic synthetic organic detergent. The formulation is for a non-sudsing product, which type of detergent is becoming preferred, at least by users of some types of atuomatic washing machines. However, by the use of anionic detergent, e.g., water soluble higher linear alkyl benzene sulfonate salts, at concentrations of 2 to 20%, in the final product, e.g., 10%, in replacement of an equal or lesser proportion of nonionic detergent, or in addition to it, a foaming product is produced of about the same final density.

EXAMPLE 2

| | Pounds |
|---|---|
| Water | 88 |
| Sodium silicate solution (40% solids) | 258 |
| Sodium linear dodecyl benzene sulfonate | 80 |
| Pentasodium tripolyphosphate | 123 |
| Soda ash | 114 |
| Soap (85:15 tallow:coco) | 25 |
| Neodol 45-11 | 10 |

The soda ash is dispersed in the water in a pilot plant crutcher and the sodium silicate solution is mixed with it, after which there are added to it the sodium linear dodecyl benzene sulfonate, soap and nonionic detergent. Following the procedure described in Example 1, the crutcher mix and drop tank temperature are maintained in the range of 175°–180°F. and the mix is sprayed through a No. 15-2 nozzle at a Triplex pump pressure of 660 lbs./sq. in. gauge into a countercurrent spray drying tower with drying air initially at a temperature of 440°F. and at 190°F. at exit. The product made has particle sizes in the range of 8 to 160 mesh after small proportions of fines and oversize particles are removed. The moisture content is 8% and the density is from 0.23–0.25 g./ml.

When the phosphate content of the product is omitted the bulk density increases to an objectionable extent but by the addition of another 25 lbs. of the soap to the crutcher mix a product of density about the same or even lower than that obtained for the above formula results. When the phosphate content is replaced pound for pound by soda ash an increase in bulk density results but the presence of the soap maintains such density in the 0.2 to 0.35 range. Similarly, when the soap is also omitted and the phosphate is replaced with soda ash the density becomes higher than 0.4 g./ml.

EXAMPLE 3

Crutcher mixes are made and post-additions of various components are effected, following the method of Example 1, with the changes indicated, so as to obtain final products of the following formulas:

| | Percent | | | |
|---|---|---|---|---|
| | A | B | C | D |
| Water | 6 | 10 | 6 | 7 |
| Sodium silicate, aqueous solution ($Na_2O:SiO_2$ = 2.4, solids content = 43.5%) | 10 | 10 | 10 | 10 |
| Soda ash | 67.3 | 62.3 | 65.3 | 65.3 |
| Soda (80:20 tallow:coco) | 2 | 2 | 2 | 3 |
| Nonionic detergent (Neodol 45-11, added in crutcher) | 0 | 1 | 2 | 0 |
| Sodium carboxymethyl cellulose (67% active ingredient, post-added) | 2.5 | 2.5 | 2.5 | 2.5 |
| Nonionic detergent (Neodol 45-11, post added) | 12 | 12 | 12 | 12 |
| Perfume (post-added) | 0.2 | 0.2 | 0.2 | 0.2 |

The crutcher mix, at 180°F., is pumped by a Triplex pump at a pressure of 250–300 lbs./sq. in., gauge, through a No. 20-3 Whirljet nozzle into drying air entering at 475°F. and leaving the countercurrent spray tower at 190°F. The products resulting have particle sizes of 6 to 140 mesh and bulk densities in the 0.2 to 0.35 g./ml. range in most cases and when such density is slightly higher, it is depressed by the addition of more soap to the crutcher mix.

When Neodol 45-11 is replaced with other surface active nonionic compounds such as Neodol 25-7, Neodol 25-3, Plurafac B-26, and Alfonic 1618-65, and when the soda ash (pulverized) is replaced by sodium sesquicarbonate, sodium bicarbonate, potassium carbonate or mixtures thereof, the lowered bulk densities are also obtained. In such cases the nonionic is also sprayable at elevated temperatures e.g., 50°C., and the beads to which it is applied may be warm from the tower, e.g., at 50°C. When the tallow:coco soap mix is replaced by commercial stearic acids (double- or triple-pressed) or by pure palmitic or stearic acid, excellent reductions in bulk density are obtained, often being better than those of the mixed tallow-coco commercial soaps. The formula is changed to a foaming formula by the addition of 10% of sodium dodecane sulfonate; sodium higher fatty acids monoglyceride sulfate (coconut oil fatty acids); sodium lauryl sulfate;

or sodium higher fatty alcohol polyethoxy sulfate; and the product resulting is lowered in bulk density despite its content of soda ash, when soap is present in the range cited.

The invention has been described with respect to specific embodiments and working examples but is not to be limited thereto because it is evident that one of ordinary skill in the art will be able to utilize substitutes and equivalents without departing from the spirit of the invention.

What is claimed is:

1. A method of spray drying alkali metal carbonate beads useful to be post-treated with a polyethoxylated nonionic organic detergent to produce a heavy duty detergent composition, the bulk density of said bead being in the range of about 0.2 to 0.35 gram per milliliter comprising admixing with a 40–75% solids content aqueous crutcher mix containing said alkali metal carbonate from about 0.75 to 4% of an alkali metal soap of a higher fatty acid and up to about 2% by weight nonionic detergent, heating and spray drying the resulting mixture, the carbonate content being approximately 20–75% by weight, and thereafter post-treating said mix with additional amounts of said nonionic detergent such that the final bead contains about 5–15% of said nonionic.

2. A method according to claim 1 wherein the alkali metal carbonate is sodium carbonate, the bulk density of the spray dried beads made is from 0.25 to 0.35 g./ml., the alkali metal soap is sodium soap of a mixture of higher fatty acids of carbon contents in the range of 12 to 18 carbon atoms per molecule and the crutcher mix is at a temperature of 170°–190°F before spraying.

3. A method according to claim 2 wherein the sodium carbonate content of the crutcher mix is such as to produce beads containing from 40 to 90% of sodium carbonate, the crutcher mix solids content is from 50 to 75% and the sodium soap is a mixture of higher fatty acids in the 12 to 18 carbon atoms range, in which those of 16 to 18 carbon atoms are from 60 to 100% and the crutcher mix is dried to a moisture content of 1 to 12%.

4. A method according to claim 3 wherein the sodium carbonate content of the crutcher mix is such as to produce beads containing from 50 to 90% of sodium carbonate, the sodium soap is a mixture of higher fatty acids of 12 to 18 carbon atoms in which those of 16 to 18 carbon atoms constitute from 75 to 100%, the sodium soap content of the crutcher mix is 2 to 4% and the temperature to which the crutcher mix is heated is from 175° to 185°F.

5. A method according to claim 4 wherein the crutcher mix also contains from 0.5 to 2% of a polyethoxylated nonionic organic detergent.

6. A method according to claim 4 wherein the crutcher mix also contains from 2 to 20% of water soluble anionic synthetic organic detergent salt.

7. A method according to claim 5 wherein the crutcher mix also contains water soluble anionic synthetic organic detergent salt and sodium silicate in such proportions as to result in 2 to 20%, respectively and 5 to 20% thereof in the spray dried beads.

8. A method according to claim 5 wherein the spray dried higher alkali metal carbonate content beads are post sprayed with a polyethoxylated nonionic organic detergent so that the content thereof in the post sprayed detergent beads is from 5 to 15% thereof and the bulk density of the product resulting is from 0.25 to 0.4 g./ml.

9. A method according to claim 7 wherein the spray dried beads are post-sprayed with a polyethoxylated nonionic organic detergent so that the total content thereof in the product is from 5 to 15%, the particle sizes of the product are in the 8 to 100 mesh range and the bulk density of the product resulting is from 0.25 to 0.4 g./ml.

10. An alkali metal carbonate bead produced by the process as defined in claim 1.

11. A detergent composition containing a minor amount of nonionic detergent derived from the beads produced in accordance with the method of claim 2.

* * * * *